US007196701B2

(12) United States Patent
Tsutsui et al.

(10) Patent No.: US 7,196,701 B2
(45) Date of Patent: Mar. 27, 2007

(54) DRIVING APPARATUS FOR DISPLAY DEVICE

(75) Inventors: Yusuke Tsutsui, Hashima (JP); Makoto Kitagawa, Gifu (JP); Mitsugu Kobayashi, Nagoya (JP); Hisao Uehara, Ogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 20 days.

(21) Appl. No.: 09/823,927

(22) Filed: Mar. 29, 2001

(65) Prior Publication Data

US 2001/0030645 A1 Oct. 18, 2001

(30) Foreign Application Priority Data

Mar. 31, 2000 (JP) ..... 2000-099890

(51) Int. Cl.
*G09G 5/00* (2006.01)

(52) U.S. Cl. ..... 345/211; 345/204; 345/212

(58) Field of Classification Search ..... 345/204–215, 345/222, 76–80, 87–95
See application file for complete search history.

(56) References Cited

U.S. PATENT DOCUMENTS

| | | | | |
|---|---|---|---|---|
| 4,155,112 | A * | 5/1979 | Miller et al. | 323/222 |
| 4,347,474 | A * | 8/1982 | Brooks et al. | 323/224 |
| 4,355,277 | A * | 10/1982 | Davis et al. | 323/351 |
| 4,544,912 | A * | 10/1985 | Iwamoto et al. | 341/158 |
| 4,584,517 | A * | 4/1986 | Schwob | 323/222 |
| 5,155,840 | A * | 10/1992 | Niijima | 713/400 |
| 5,537,650 | A * | 7/1996 | West et al. | 713/324 |
| 5,552,836 | A * | 9/1996 | Nobuoka | 348/730 |
| 5,910,891 | A | 6/1999 | Jo | 363/89 |
| 5,991,883 | A | 11/1999 | Atkinson | |
| 6,078,319 | A * | 6/2000 | Bril et al. | 345/211 |
| 6,087,816 | A * | 7/2000 | Volk | 323/282 |
| 6,297,622 | B1 * | 10/2001 | Yatabe | 323/222 |
| 6,323,851 | B1 * | 11/2001 | Nakanishi | 345/211 |
| 6,380,982 | B1 * | 4/2002 | Obitsu | 348/552 |

FOREIGN PATENT DOCUMENTS

| | | |
|---|---|---|
| EP | 0-707301 | 4/1996 |
| JP | 04-095995 | 3/1992 |
| JP | A 10-164840 | 6/1999 |
| JP | 11-202842 | 7/1999 |
| JP | A 11-202842 | 7/1999 |
| JP | 11-282435 | 10/1999 |

* cited by examiner

*Primary Examiner*—Vijay Shankar
(74) *Attorney, Agent, or Firm*—Hogan & Hartson LLP

(57) ABSTRACT

A power supply circuit (300) for a display device such as a liquid crystal outputs a boosted supply voltage VDD2 during normal operation, and generates a non-boosted supply voltage VDD2 having a voltage lower than that during the normal display operation by controlling the switches for switching the output within the power supply circuit (300) during a power save mode. The non-boosted supply voltage is supplied to the analog circuits of a driving circuit (100) so that the power consumption at the analog circuits is reduced. By controlling the switch for switching the output within the power supply circuit and the supply of the power supply clock, the circuit can be switched, in the power save mode, to either a mode where a lower supply voltage is generated or to a mode where the power supply is turned off.

27 Claims, 11 Drawing Sheets

DRIVING APPARATUS FOR DISPLAY DEVICE

BACKGROUND OF THE INVENTION

1. Field of the Invention

The present invention relates to a display device and in particular to a driving apparatus for a display device having a power save mode and reduced power consumption.

2. Description of the Related Art

Flat panel display devices such as a liquid crystal and an organic EL display devices are generally thin, lightweight, and consume less power. Because of these characteristics, flat panel display devices are suited for use as display devices for portable devices, such as mobile phones, and have therefore come to be widely employed in many such portable devices.

FIG. 1 shows a structure of a liquid crystal display device used as a display device for a mobile phone. The liquid crystal display device comprises a liquid crystal display (LCD) panel 200 constructed by sealing liquid crystal between a pair of substrates, a driving circuit 101 for driving the LCD panel 200, and a power supply circuit 350 for supplying the required supply voltage to the driving circuit 101 and LCD panel 200.

The driving circuit 101 comprises a latch circuit 10 for latching supplied RGB digital data, a digital-to-analog (D/A) converter circuit 12 for converting the latched data to analog data, and an amplifier 14 for amplifying the converted analog data and supplying it to the liquid crystal display panel 200 as R, G, and B analog display data. The driving circuit 101 further comprises a timing controller (T/C) 22 and a CPU interface (I/F) circuit 20 for receiving an instruction from a CPU (not shown) and outputting a control signal in response to the instruction. The T/C 22 generates a timing signal suited to display on the liquid crystal display panel 200 based on timing signals such as a dot clock DOTCLK, horizontal synchronization signal Hsync, and vertical synchronization signal Vsync.

The power supply circuit 350 generates a plurality of supply voltages as necessary. The power supply circuit 350 supplies a supply voltage VDD1 of a low voltage to the latch circuit 10 for performing digital signal processing and which is constructed from a CMOS logical circuit suited for low voltage driving, a supply voltage VDD2 of a higher voltage to the D/A converter circuit 12 and amplifier 14, and a supply voltage VDD3 of an even higher voltage to the LCD panel 200.

FIGS. 2A and 2B show two structures of a related art power supply circuit for generating the voltage VDD2 of the plurality of voltages. FIG. 2A shows a switching regulator type power supply circuit 350 and FIG. 2B shows a charge pump type power supply circuit 350.

The switching regulator type power supply circuit 350 depicted in FIG. 2A comprises a boosting section 351 including a coil L1 and a diode D1 provided, in that order, between the input and output, an oscillation circuit 35*s* for oscillating a predetermined pulse signal, and a transistor Tr36 for receiving the pulse signal from the oscillation circuit 35*s* at its gate. The power supply circuit 350 boosts the input voltage VIN at the coil L1 and diode D1 by controlling the transistor Tr36 on and off using the pulse signal from the oscillation circuit 35*s*. The obtained boosted supply voltage VDD2 is then supplied to the liquid crystal driving circuit 101 as its operation power supply. The power supply circuit 350 further comprises voltage dividing resistive elements R37 and R38 between its output end and the ground. A comparator 36 compares the divided voltage between the resistive elements R37 and R38 with a reference voltage Vref, and outputs a comparison signal. By controlling the oscillation frequency of the oscillation circuit 35*s* based on the comparison signal corresponding to the output voltage VDD2 from the comparator 36, the overall circuit is controlled so that the output voltage VDD2 remains stable.

The charge pump type power supply circuit 350 depicted in FIG. 2B comprises two capacitors C1 and C2, capacitor switches SW1 through SW4 for switching the supply route of the input voltage to the capacitors, an oscillation circuit 35*c* for generating a pulse signal for controlling the switching of the switches SW1 through SW4, an AND gate 37, and a NAND gate 39.

The oscillation circuit 35*c* generates a pulse signal having, for example, a duty ratio of 1/2. The pulse signal is supplied to the switches SW1 and SW2 via the AND gate 37 and to the switches SW3 and SW4 via the NAND gate 39, so that the groups of switches SW1 and SW2 and SW3 and SW4 are alternately opened and closed.

When switches SW3 and SW4 are closed, the input voltage VIN is applied to the electrode of the capacitor C1 at the upper side of the drawing, the lower electrode becomes the ground (GND), and, thus, the capacitor C1 is charged. At the next timing, the switches SW3 and SW4 are opened and the switches SW1 and SW2 are closed. In this case, the input voltage VIN is applied to the lower electrode of the capacitor C1, the voltage at the upper electrode of the capacitor C1 is boosted to a voltage of twice the input voltage VIN, and the output voltage VDD2 having a voltage of twice the input voltage VIN is obtained at the output end provided between the upper electrodes of the capacitors C1 and C2.

There is a strong demand for reducing the power consumption in portable instruments such as mobile phones and, therefore, in the display devices for such instruments. In order to satisfy this demand, a power save mode, in which the device power supply is controlled to be turned off in order to reduce the power consumption, is commonly employed.

The display device depicted in FIG. 1 also includes such a power save mode. The I/F circuit 20 analyzes a power save control instruction transmitted from a CPU (not shown) and generates a power save control signal. The power save control signal is supplied to the power supply circuits 350 of FIGS. 2A and 2B and may be, for example, a signal having different levels during the normal operation and during the power save mode. Both power supply circuits 350 of FIGS. 2A and 2B have a structure in which the generation of the supply voltage VDD2 is suspended when the power save control signal becomes a level indicative of the power save mode. Although not shown, the power supply VDD3 is similarly controlled to be turned off and the supply of the power supply to the LCD panel 200 is also suspended.

The power supply circuit 350 depicted in FIG. 2A includes transistors Tr35, Tr37, and Tr38, resistive elements R35 and R36, and an inverter 38 to adapt the power save mode. The power save control signal is low (L level) during the normal operation mode and high (H level) during the power save mode.

During the normal operation mode, the oscillation circuit 35*s* receives a power save control signal of L level and performs oscillation operation. The transistor Tr37 is turned on and, subsequently, the transistor Tr35 provided at the input-to-output route is turned on. At this point, the transistor Tr38 connected between the output end of the power supply circuit 350 and the ground is controlled to be turned off. Thus, during the normal operation, the voltage VDD2 obtained by boosting the input voltage VIN at the boosting section 351 is output.

During the power save mode, the power save control signal becomes H level. The oscillation circuit 35*s* suspends its oscillation operation, the transistor Tr37 is turned off, the transistor Tr35 is controlled to be turned off, and, thus, the output from the boosting section 351 is shut out. Moreover, because the transistor Tr38 is turned on, the output end is connected to ground. The output of the power supply circuit 350 becomes 0V, that is, the power supply circuit 350 is controlled to be turned off.

The power supply circuit 350 depicted in FIG. 2B, on the other hand, receives a power save control signal of H level during the normal operation and of L level during the power save mode, and generates a pulse signal when the power save control signal is at the normal H level. As a result, the groups of switches SW1 and SW2, and SW3 and SW4 are alternately controlled to be switched, the charge pump is enabled, and an output voltage VDD2 having a higher voltage than the input voltage VIN can be obtained. During the power save mode, on the other hand, when the power save control signal becomes L level, the oscillation circuit 35*c* stops its operation, the output of the AND gate 37 is fixed at L level, and the output of the NAND gate 39 is fixed at H level. Because of this, the capacitors C1 and C2 are discharged, output voltage is reduced, and, thus, the power supply circuit 350 is controlled to be turned off.

As described above, in the related art power supply circuits comprising a power save mode, the power consumption at the driving circuit 101 and at the LCD panel 200 is shut down in order to reduce the power consumption as a display device by controlling the power supply supplied to the driving circuit 101 and LCD panel 200 of the display device to be turned off during the power save mode.

However, when the power supply circuit is controlled to be turned off during the power save mode, the display device will be unable to display. In a mobile phone, for example, when the power save mode is activated, because the display power supply is controlled to be turned off, information such as the time of day indicated by the internal clock and radio wave conditions cannot be shown.

According to another related method, in order to enable display even during the power save mode, rather than the display power being switched off, the driving frequency of the display device is reduced. However, in a display device, unlike in a CPU, a reduction in the driving frequency not only reduces the operation speed but will also significantly affect the display quality. When the frequency becomes lower than a certain frequency, display flicker is produced, resulting in a significant degradation of the display quality. Therefore, there is a limit to how much power can be saved by reducing the driving frequency and therefore this method is not effective in reducing the power consumption.

Also, although the power consumption can be reduced by reducing the driving frequency in a digital processing circuit such as, for example, a latch circuit, where power is consumed when the signal is changed from H to L or from L to H, the power consumption cannot be reduced in an analog processing circuit such as a D/A converter circuit, an amplifier, or the like because the power consumption is for the most part independent of the driving frequency. Thus, reduction in the driving frequency is not by itself an effective means for reducing power consumption.

moreover, in order to enable display at a lower than normal reducible driving frequency, the design of the element structure within the LCD panel and the liquid crystal material or the LCD driving method must be change. As a result, a large design change is required, which can greatly add to the cost of the resulting display device.

SUMMARY OF THE INVENTION

The present invention is conceived to solve the above problem and one object of the present invention is to realize a display device which power consumption during a power save mode is reduced using an easier and more effective method, and yet which is capable of display even during the power save mode.

In order to achieve the object mentioned above, the present invention is characterized in the following.

According to one aspect of the present invention, there is provided a driving apparatus for a display device comprising a driving circuit for generating a signal for allowing the display section to display, the driving circuit including a digital signal processing circuit for processing a digital signal, a digital-to-analog converter circuit for converting an digital signal into an analog signal, and an analog signal processing circuit for processing an analog signal; and a power supply circuit for generating a supply voltage for the driving circuit, wherein, when a predetermined power save is instructed, the power supply circuit reduces the supply voltage to be supplied to the digital-to-analog converter circuit and to the analog signal processing circuit to less than that during the normal operation.

According to another aspect of the present invention, in the driving apparatus, a plurality of potential dividing resistive elements connected in series to the power supply from the power supply circuit are provided at the digital-to-analog converter circuit, the supply voltage is divided into a plurality of stages by the potential dividers, a divided voltage is selected corresponding to the digital data, and an analog signal is output.

According to another aspect of the present invention, there is provided a driving circuit for a display device for generating a signal for allowing a display section to display, the driving circuit comprising a digital signal processing circuit for processing a digital signal; a digital-to-analog converter circuit for converting a digital signal into an analog signal; and an analog signal processing circuit for processing an analog signal, wherein, when a predetermined power save is instructed, the digital-to-analog converter circuit and the analog signal processing circuit are operated at a supply voltage lower than that employed during the normal operation.

As described, the supply voltage to the digital-to-analog-converter circuit and to the analog signal processing circuit within the driving circuit is reduced when a power save is instructed. As a result, the power consumption at these circuits for processing an analog signal can be reduced. Moreover, the circuits for processing the analog signal according to the present invention can be operated even when the supply voltage is reduced, and, thus, are capable of generating a signal for allowing the display section to display even during the power save mode. Therefore, the display device is capable of display even during the power save mode.

According to another aspect of the present invention, in the driving apparatus, the power supply circuit comprises a boosting section for boosting the input voltage; a feedback section for controlling the boosting section to maintain the supply voltage by detecting the supply voltage at the output end of the power supply as a resistor divided voltage and comparing the divided voltage with a reference voltage; a plurality of resistive elements having different resistance values from each other and connected to the output end of the power supply for detecting the supply voltage; and a selector switch for selecting a resistive element to be connected to the feedback section from among the plurality of resistive elements, wherein the input divided voltage value of the supply voltage to the feedback section is changed in response to the resistance value of the resistive element selected by the selector switch, and the output supply voltage to the digital-to-analog converter circuit and to the analog signal processing circuit is changed.

According to another aspect of the present invention, in the power supply circuit, a resistive element with a smaller resistance value is selected by the selector switch when reduction in the output supply voltage is requested, so that the input divided voltage value to the feedback section is increased.

According to another aspect of the present invention, in the driving apparatus for a display device, the power supply circuit comprises a boosting section for boosting the input voltage; a boosted power supply output switch for controlling passage from the boosting section to the output end of the power supply; and a non-boosted power supply output switch bypassing the input and the output ends of the power supply; wherein the two switches are controlled to be switched so that one of the boosted power supply or non-boosted power supply is output.

If the power supply circuit is capable of selecting and outputting one of the boosted or the non-boosted supply voltage as described above, it is possible, when a power save mode instruction is generated, to supply, with a simple structure, a supply voltage to the digital-to-analog converter circuit and to the analog signal processing circuit having a voltage lower than that during the normal operation, but yet sufficient to operate these circuits. Thus, the digital-to-analog converter circuit and the analog signal processing circuit can be operated by the non-boosted supply voltage even during the power save mode.

According to another aspect of the present invention, in the driving apparatus, the supply circuit comprises a boosting section for boosting the input voltage by controlling and switching a plurality of switches for capacitors, the boosting section including a plurality of capacitors and a plurality of switches for the capacitors, a boosted power supply output switch for controlling passage between the boosting section and the output end of the power supply, and a non-boosted supply voltage output switch for bypassing the input end of the power supply to the output end of the power supply, wherein a power supply clock produced by the driving circuit using the system clock is used for switching and controlling the plurality of switches for capacitors, and either one of the boosted or non-boosted supply voltage is output to the digital-to-analog converter circuit and to the analog signal processing circuit, or the supply voltage output to these circuits is suspended in response to the switch control of the output switches and the power supply clock.

Alternatively, the power supply circuit may employ a clock from a predetermined oscillation circuit for switching and controlling the plurality of switches for capacitors, and output the boosted or the non-boosted supply voltage to the digital-to-analog converter circuit and to the analog signal processing circuit, or suspend the output of the supply voltage to these circuits in response to the switching control of the output switches and the clock from the oscillation circuit.

Such a driving apparatus for a display device according to the present invention is capable of operating at least three types of power supply generation operations, and can adopt many operation modes such as, for example, a plurality of power save modes, in addition to the normal operation mode to reduce the power consumption while maintaining the device functions or to set the highest priority on the reduction of power consumption, etc. In other words, it is possible to provide a high performance device which can adopt various power save modes, such as, for example, a mode where display is enabled by generating a non-boosted supply voltage when the demand for reduction of power consumption is not great, and a mode where the power supply is controlled to be turned off so that the power consumption at the circuits or the like which use this power supply as their operation power supply is shut down when the demand for reduction of power consumption is higher.

According to another aspect of the present invention, in the power supply circuit, the integrated circuit determines the mode of the device, boosted power supply generation mode, non-boosted power supply generated mode, or the power supply suspension mode, based on a predetermined power save control instruction, and can control to supply or to suspend the supply of the power supply clock or, to supply or to suspend the supply of the clock from the oscillation circuit, and to open or close the output switches.

Such supply or suspension of the supply of a clock can be controlled by a simple structure based on, for example, an instruction from a CPU or the like. The control for opening/closing the switches can also be realized with a simple structure. Thus, the device can have a simple structure and still adopt a plurality of operation modes.

DESCRIPTION OF PREFERRED EMBODIMENTS

The preferred embodiments of the present invention (referred to as "embodiments" hereinafter) will be described below with reference to the drawings.

First Embodiment

Figure 3:
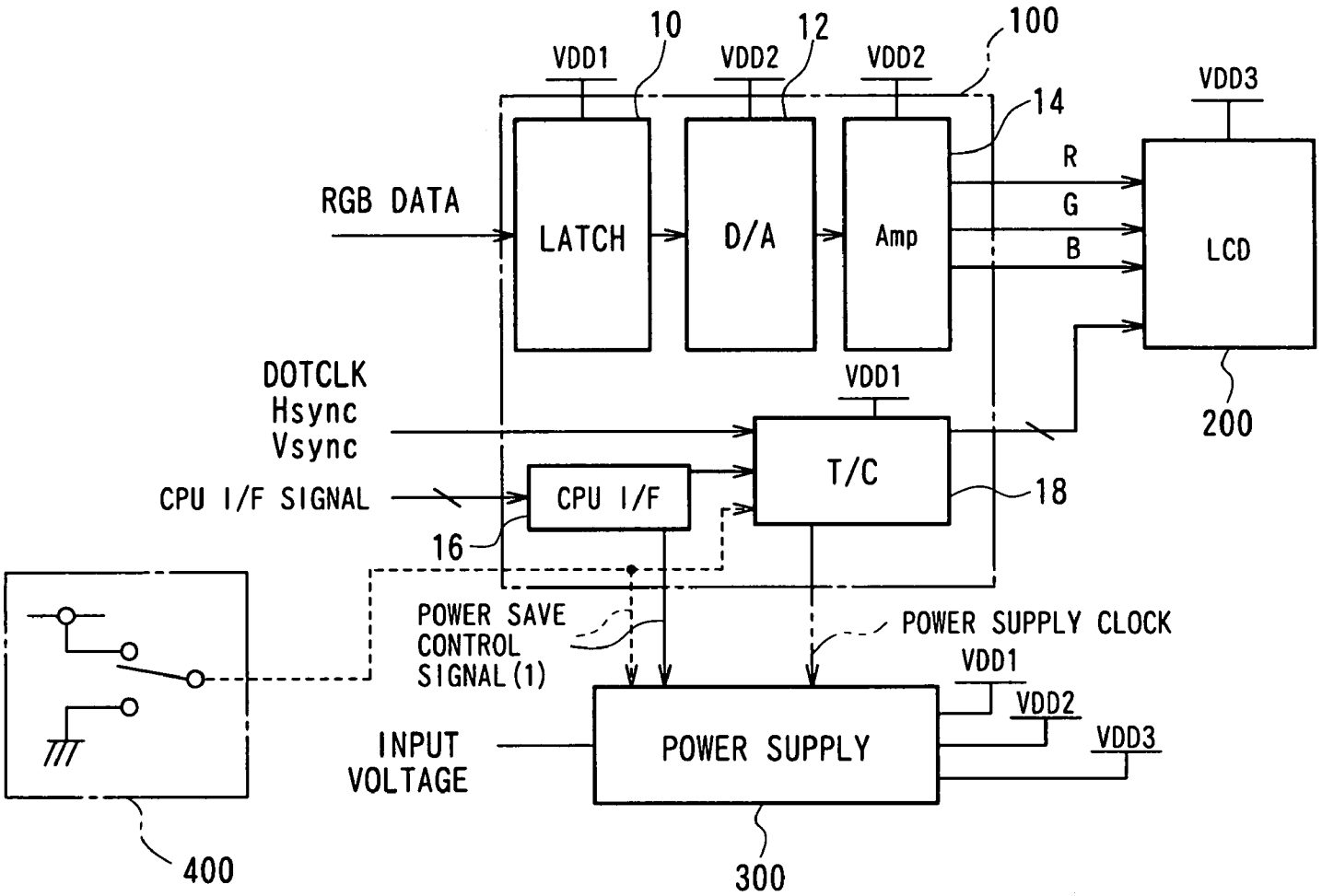
FIG. 3 is a diagram showing a structure of a display device according to the present invention.

FIG. 3 schematically shows the structure of a display device with a power save mode according to a first embodiment of the present invention. The display device is a flat panel display device such as, for example, an LCD of a mobile phone, and comprises a display panel (referred to as LCD panel hereinafter) 200, a driving circuit 100, and a power supply circuit 300 for supplying a plurality of necessary supply voltages (for example, VDD1, VDD2, and VDD3) to the driving circuit 100 and to the panel 200.

Figure 1:
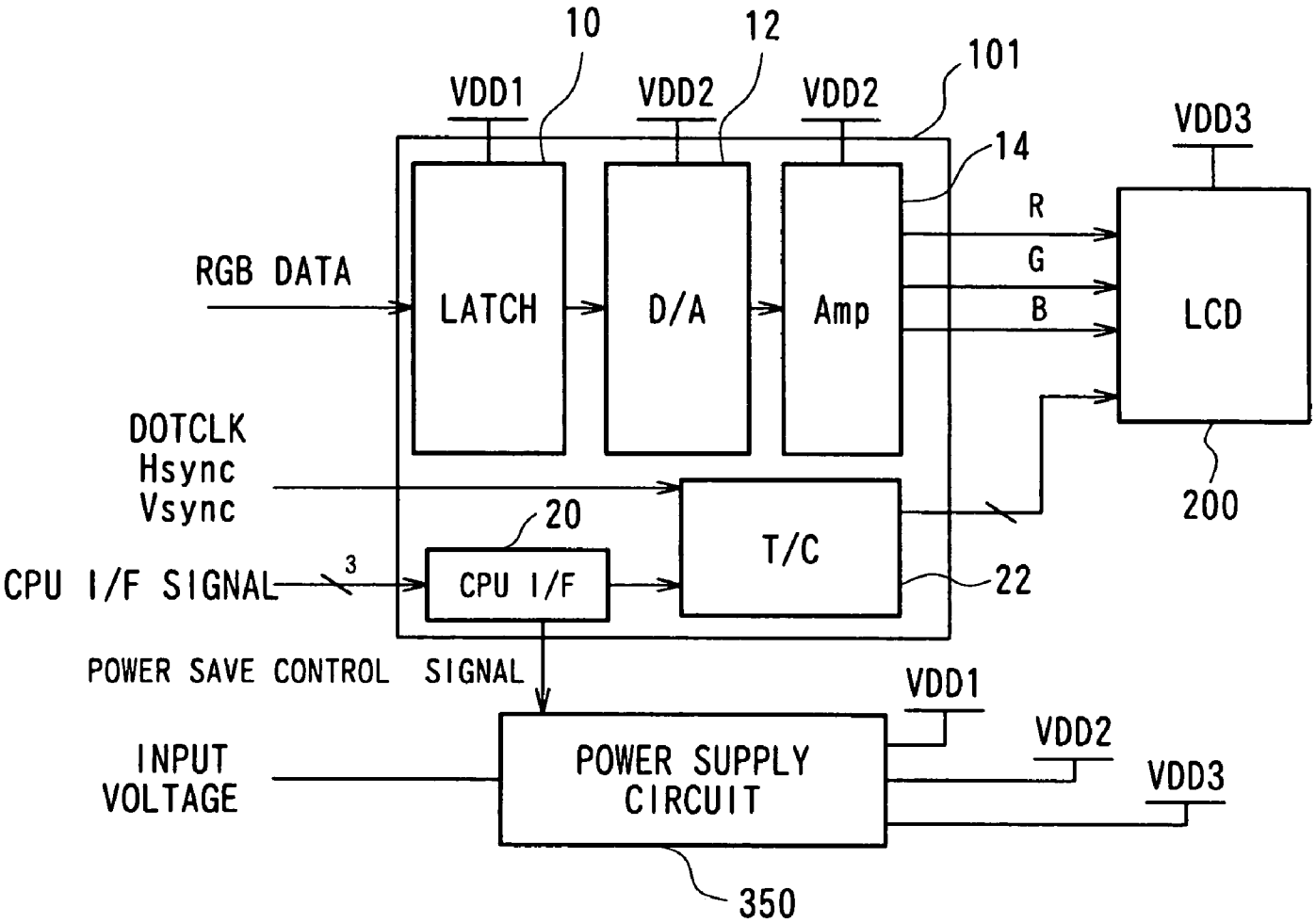
FIG. 1 RELATED ART
FIG. 1 is a diagram showing a structure of a related art liquid crystal display device.

The driving circuit 100, similar to that shown in FIG. 1, comprises a latch circuit 10 which is a digital signal processing circuit for processing a digital signal, a D/A converter circuit 12, and an amplifier 14 which are analog signal processing circuits; an I/F circuit 16, and T/C 18. The I/F circuit 16 receives and analyzes an instruction transmitted from a CPU (not shown) and outputs a control signal corresponding to the instruction. The instruction transmitted from a CPU includes an adjustment instruction for the display position within the display panel and a contrast adjustment instruction, in addition to the power save control instruction. These control instructions are represented in predetermined digital control data. The I/F circuit 16 captures the digital control data (S-DATA) according to a load signal (S-LOAD) and a CPU clock (S-CLOCK), and generates a control signal corresponding to the control data. The structure of the I/F circuit 16 and the generation operation of the power save control signal are identical to a second embodiment (FIGS. 9 and 10(*a*) through (*i*)) to be described later, and will not be described here. The T/C 18 in the first embodiment generates a timing signal suited for display at the LCD panel 200 based on timing signals such as the dot clock DOTCLK, a horizontal synchronization signal Hsync, and a vertical synchronization signal Vsync, and outputs the generated timing signal to the LCD panel 200.

In the device according to this first embodiment, a supply voltage VDD2 is supplied during the power save mode to the analog processing circuits, more specifically to the D/A converter circuit 12 and to the amplifier 14, within the driving circuit 100, the supply voltage VDD2 having a voltage lower than that during the normal operation, but sufficient to operate these circuits, by the power supply circuit 300 to be described below. In this manner, the power consumption at these analog circuits are reduced while enabling display at the display section during the power save mode.

(Switching Regulator Type Power Supply Circuit)

Figure 4:
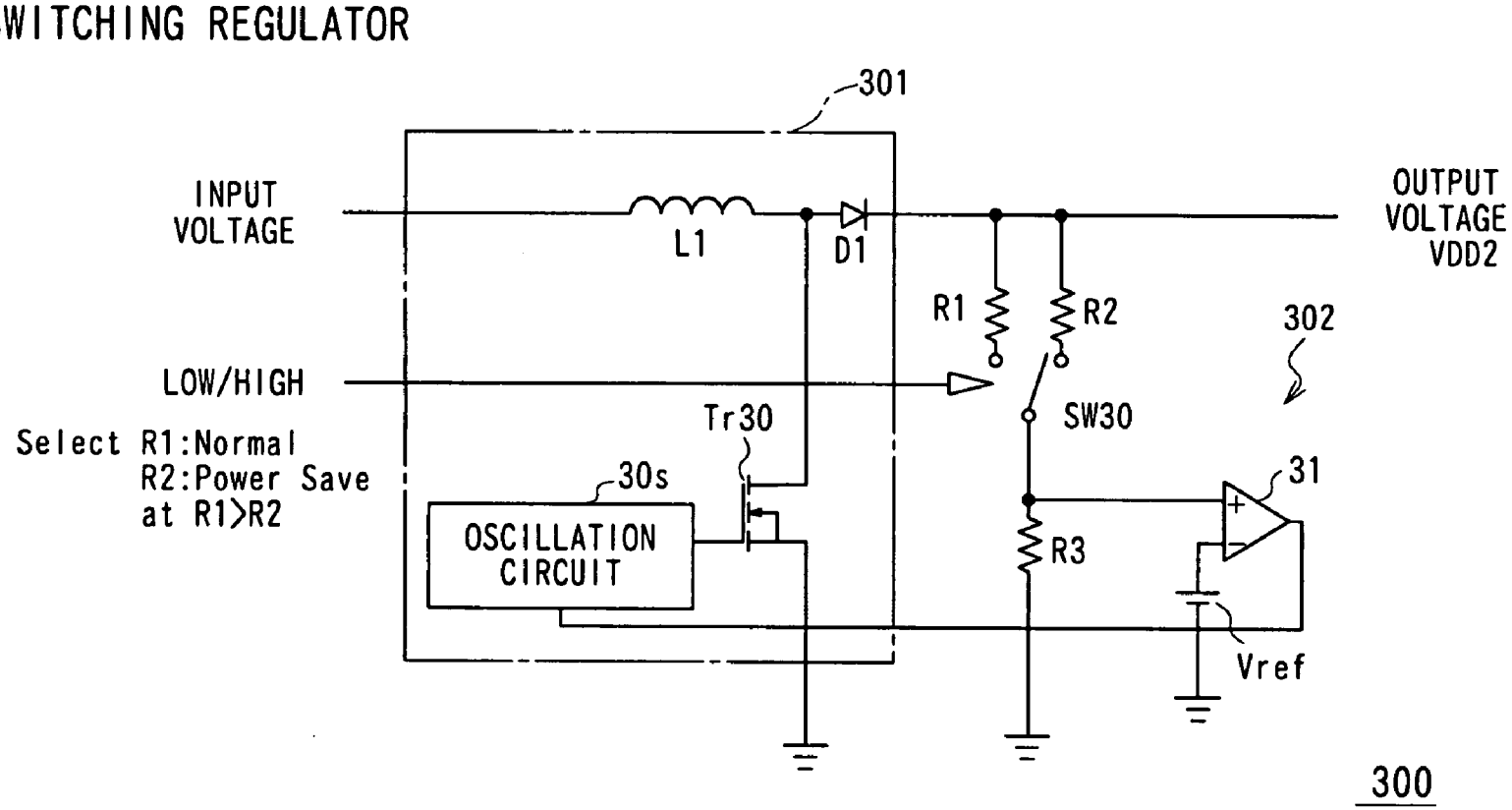
FIG. 4 is a diagram showing the structure of a switching regulator type power supply circuit of the display device according to a first embodiment of the present invention.

FIG. 4 shows a circuit structure for generating the voltage VDD2 in a power supply circuit 300 according to the present embodiment. The power supply circuit 300 is a switching regulator type power supply circuit with a power save mode. The power supply circuit 300, rather than being turned off, generates a supply voltage VDD2 which has lower voltage than that during the normal operation mode, and supplies this generated voltage to the D/A converter circuit 12 and amplifier 14 during the power save mode. The supply voltage VDD2 during the power save mode is set so that it is lower than that during the normal operation mode, but is sufficient to operate the D/A converter circuit 12 and the amplifier 14.

Figure 2A:
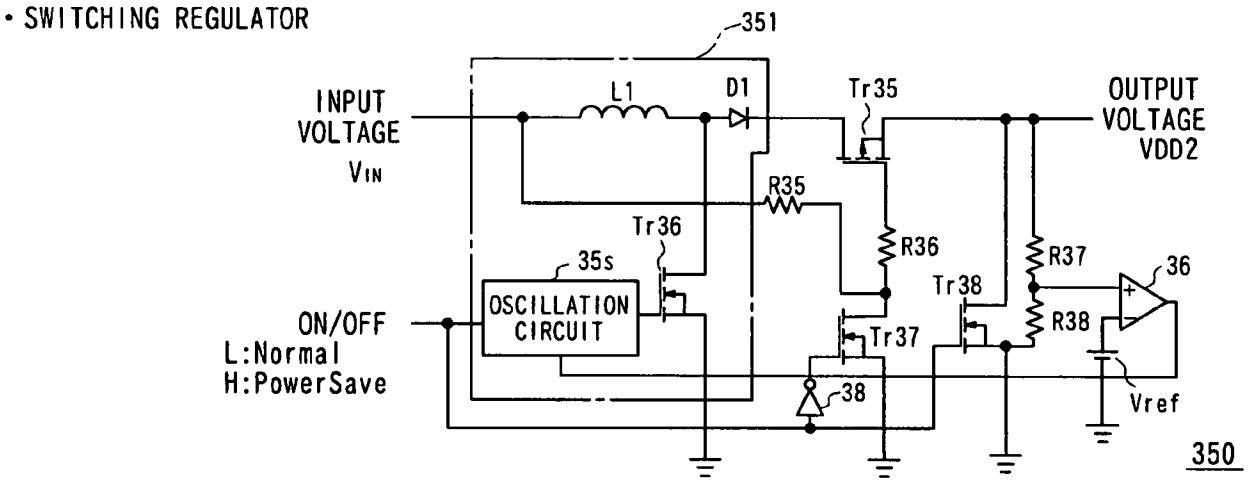
FIG. 2A RELATED ART
FIGS. 2A and 2B are diagrams each showing a structure of the power supply circuit 350 depicted in FIG. 1.

The power supply circuit 300 includes a boosting section 301 and a feedback section 302. Similar to the boosting section 351 shown in FIG. 2A, the boosting section 301 includes a coil L1 and a diode D1 placed between the input and output, an oscillation circuit 30*s*, and a transistor Tr30 which turns on and off in response to a pulse signal received at its gate from the oscillation circuit 30*s*, for switching the voltage at the point between the coil L1 and diode D1.

The feedback section 302 includes resistive elements R1 and R2 connected to the output end of the power supply, a resistive element R3 connected to the resistive elements R1 and R2 for generating a resistance divided voltage, and a comparator 31 for comparing the divided voltage value of the output supply voltage detected by the resistive elements with a reference voltage Vref. The boosting operation at the boosting section 301, that is, the oscillation frequency of the oscillation circuit 30*s* is controlled to maintain the output supply voltage detected by the resistor divided voltage.

The other ends of the resistive elements R1 and R2 having one end connected to the output end of the power supply are connectable via a selector switch SW30 to a resistive element R3 connected to the ground. The resistance value of the resistive element R1 is larger than the resistance value of the resistive element R2. The switch SW30 selects the resistive element R1 when the power save control signal from the I/F circuit 16 indicates a normal operation mode (for example, H level) and selects the resistive element R2 when the power save control signal indicates a power save mode (for example, L level).

The positive input end of the comparator 3,1 which corresponds to the input of the feedback section 302, is connected to a point between the selected resistive element R1 or R2, selected by the switch SW30 and the resistive element R3. A divided voltage of the output voltage is applied to the positive input end and the reference voltage Vref is applied to the negative input end. Therefore, the comparator 31 compares the divided voltage which corresponds to the resistance ratio between the resistive elements R1 and R3 or between the resistive elements R2 and R3 with the applied reference voltage Vref, and outputs a comparison signal. The oscillation frequency of the oscillation circuit 30*s* is controlled by the comparison signal.

As described above, when the power save control signal is, for example, at H level during the normal operation, the switch SW30 selects a resistive element R1 having a higher resistance, and, therefore, the voltage input to the positive input end of the comparator 31 will be a predetermined lower voltage. The positive input voltage is compared with the reference voltage Vref, and the oscillation frequency of the oscillation circuit 30*s* is controlled so that the voltage at the positive input end of the comparator 31 does not decrease. The transistor Tr30 is turned on and off in response to the oscillation signal and the output supply voltage from the power supply circuit 300 to the analog circuits in the driving circuit is maintained at a predetermined high voltage VDD2 (for example, 5V).

When, on the other hand, power save is instructed by the CPU (not shown), the power save control signal changes to, for example, L level, and the switch SW30 selects the resistive element R2 having a lower resistance than the resistive element R1. Because of this, a voltage higher than during normal operation is input to the positive input end of the comparator 31. The positive input voltage is compared with a reference voltage Vref equal to the reference voltage during the normal operation. Thus, the oscillation frequency of the oscillation circuit 30*s* is changed (reduced) so that the voltage at the positive input end of the comparator 31 is low (equal to the voltage when R1 is selected), that is, the output supply voltage VDD2 is low. In this manner, the transistor Tr30 is controlled to be turned on and off by the pulse signal from the oscillation circuit 30*s* with a lower frequency, and the output voltage VDD2 from the power supply circuit 300 becomes and is maintained at a voltage lower than that during the normal operation (for example, 3V).

As described, by switching between the resistive elements R1 and R2 by the switch SW30, it is possible to control the output voltage of the switching regulator type power supply circuit 300 during the power save mode to be a predetermined voltage lower than that during the normal operation, instead of 0V.

(Charge Pump Type Power Supply Circuit)

Figure 2B:
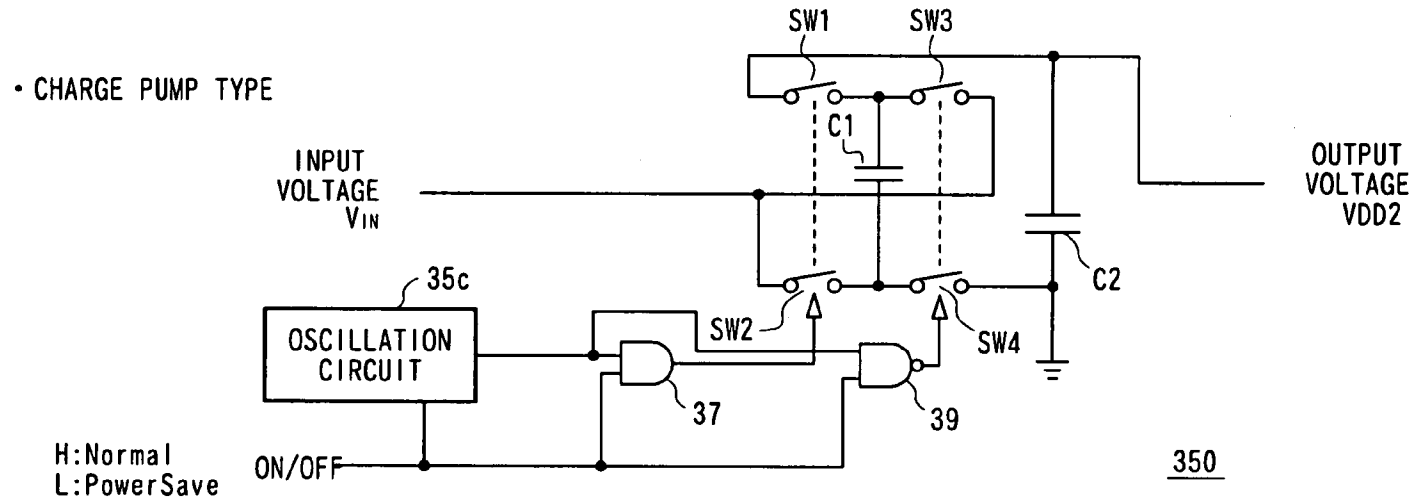
FIG. 2B RELATED ART

A charge pump type power supply circuit with a power save mode according to the first embodiment will now be described with reference to FIG. 5. The power supply circuit 300 depicted in FIG. 5 generates a supply voltage VDD2 of voltage twice the input voltage Vin during the normal operation and generates a supply voltage VDD2 of voltage equal to the input voltage Vin, and, subsequently, lower than the supply voltage during the normal operation, during the power save mode. The oscillation circuit 30*c*, switches SW1 through SW4 for capacitors, an AND gate 32, a NAND gate 33, and capacitors C1 and C2 are identical to those for the power supply circuit 350 of the related art shown in FIG. 2B. The power supply circuit 300 of the embodiment further includes a structure for switching the output voltages during the normal operation and during power save mode, the structure comprising a transistor Tr31 and an inverter 34 as the boosted supply voltage output switch and a transistor Tr32 as the non-boosted supply voltage output switch.

During the normal operation, a power save control signal having H level and output from the I/F circuit 16 controls, via an inverter 34, the transistor Tr31 provided at the output end of the boosting section (charge pump) 303 to be turned on. The power save control signal also controls a transistor Tr32 provided for bypassing the input and output ends to be turned off. Thus, during the normal operation, the output voltage VDD2 (for example, at 5V) obtained by boosting the input voltage Vin by alternately switching between the switches SW1 and SW2, and SW3 and SW4 can be output via the transistor Tr31. During the power save mode, on the other hand, the power save control signal becomes L level. The transistor Tr31 is controlled to be turned off and the transistor Tr32 is controlled to be turned on. Thus, during the power save mode, the input and output ends of the power supply circuit are bypassed by the transistor Tr32, and the output from the boosting section 303 is shut off by the transistor Tr31. Therefore, a non-boosted supply voltage, that is, the input voltage Vin itself, is output as the supply voltage VDD2 during the power save mode from the power supply circuit 300 of FIG. 5.

(Driving Circuit 100)

Figure 6:
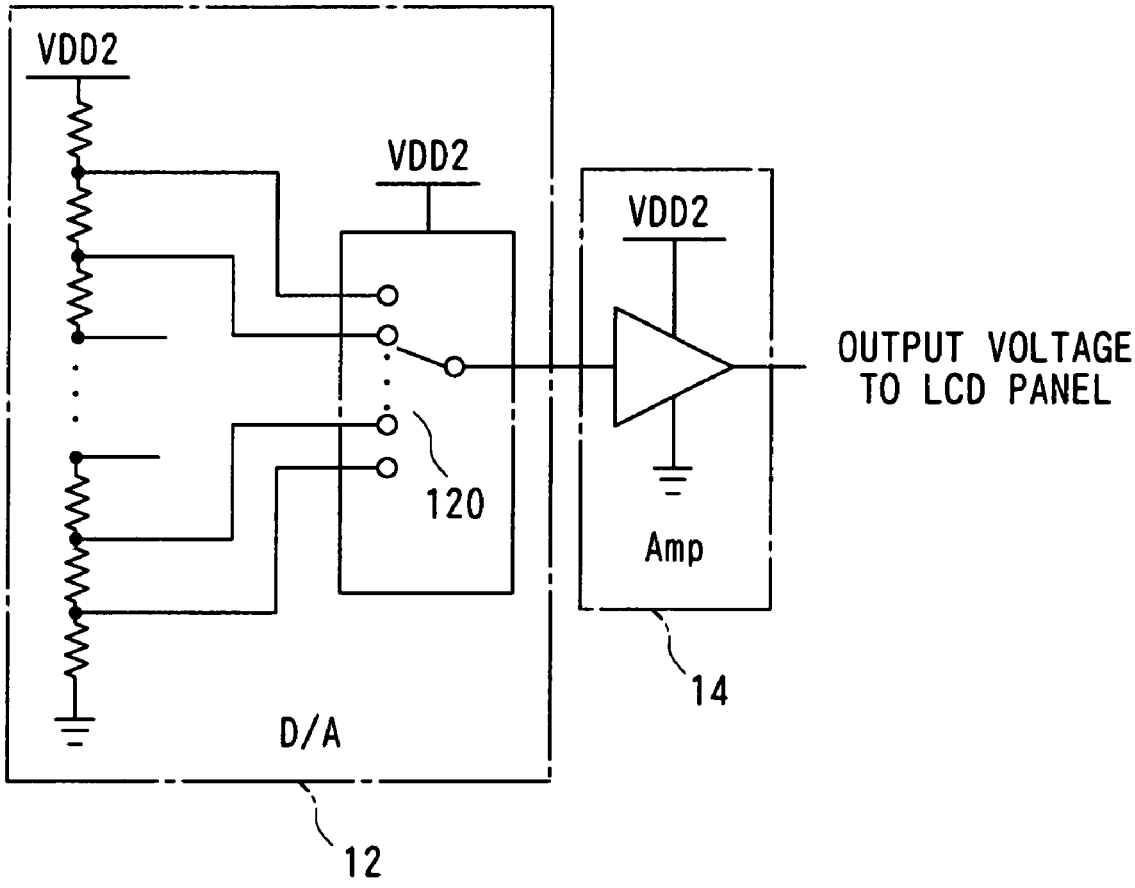
FIG. 6 is a diagram showing a structure of a D/A converter circuit of the display device according to the first embodiment of the present invention.
Figure 7:
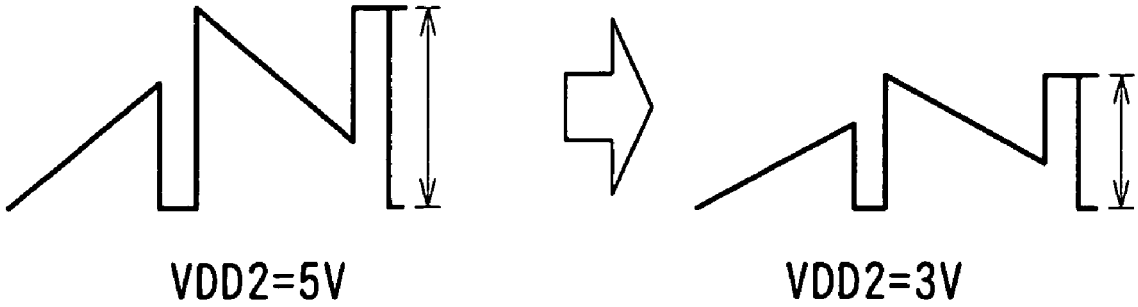
FIG. 7 is a diagram showing the signal waveforms which can be created by the structure shown in FIG. 6.

The D/A converter circuit 12 and amplifier 14 depicted in FIG. 3, which operate by receiving the supply voltage VDD2 from the power supply circuit 300 shown in FIG. 4 or in FIG. 5 will now be described with reference to FIGS. 6 and 7. As described above, the supply voltage VDD2 output from the power supply circuit 300 of the first embodiment is controlled so that the voltage will be lower during the power save mode than during normal operation. In the example of the present embodiment, a resistor type D/A converter (RDAC) circuit is employed as the D/A converter circuit 12, having a plurality of dividing resistive elements connected in series between the power supply (VDD2) and the ground, as shown in FIG. 6.

The D/A converter circuit 12 is able to perform the conversion operation even when the supply voltage VDD2 is reduced. The divided voltage output from each of the dividing resistive elements changes when the supply voltage VDD2 of the dividing resistive element is changed between the normal operation (5V) and power save mode (3V). Therefore, by switching the switch 120 in the same manner as during the normal operation in response to the supplied digital data, the voltage level of the output analog signal is altered in response to the change in the supply voltage VDD2 as shown in FIG. 7. As a result, the amplitude of the analog signal can be adjusted. The D/A converter circuit 12 is not limited to a RDAC type, but can be any form that is capable of the conversion operation even when the supply voltage is reduced and which can obtain an analog signal in response to the supply voltage and input digital data.

The amplifier 14 amplifies the analog signal with the amplitude changed in response to the change in the supply voltage, using the supply voltage VDD2 and outputs the resulting signal to the LCD panel 200.

When the power supply VDD2, which acts as the power supply for the resistor divided voltage, is reduced, the power consumption at the D/A converter circuit 12 is also reduced, and the operation power supply VDD2 of the amplifier 14 is similarly reduced, resulting in reduction in the power consumption.

In this manner, by controlling the supply voltage VDD2 to be lower during the power save mode than during the normal operation, power consumption at the circuits for performing analog processes can be reduced during the power save mode, and, thus, the overall power consumed by the device as a whole can be reduced.

In the above example, the supply voltage of the power supply circuit 300 is controlled based on a power save control signal output from the I/F 16 in response to a power save control instruction from the CPU (not shown). However, it is also possible to generate the power save control signal by providing a switch 400 which can be operated by the device user or the like. The power save control signal in this case is then supplied to the power supply circuit 300, as shown by a dotted line in FIG. 3. It is also possible to configure a structure wherein the power supply circuit can be operated by receiving a power save control instruction from the CPU, and at the same time, can be controlled to be in the power save mode by a device user.

Second Embodiment

A power supply circuit with power save mode according to a second embodiment of the present invention, and an apparatus using such circuit will now be described referring to FIG. 3 and FIGS. 8 through 11. In the display device of the example of the first embodiment as described above, the power supply is controlled so that the supply voltage VDD2 to the analog circuit is lower during the power save mode than during the normal operation, rather than being turned off. In the second embodiment, on the other hand, a plurality of modes are provided for the power save mode, and it is possible, in mode 1, to control the supply voltage VDD2 to the analog circuit to be lower than during the normal operation similar to the first embodiment, and, in mode 2, to control the supply voltage to be turned off.

Figure 8:
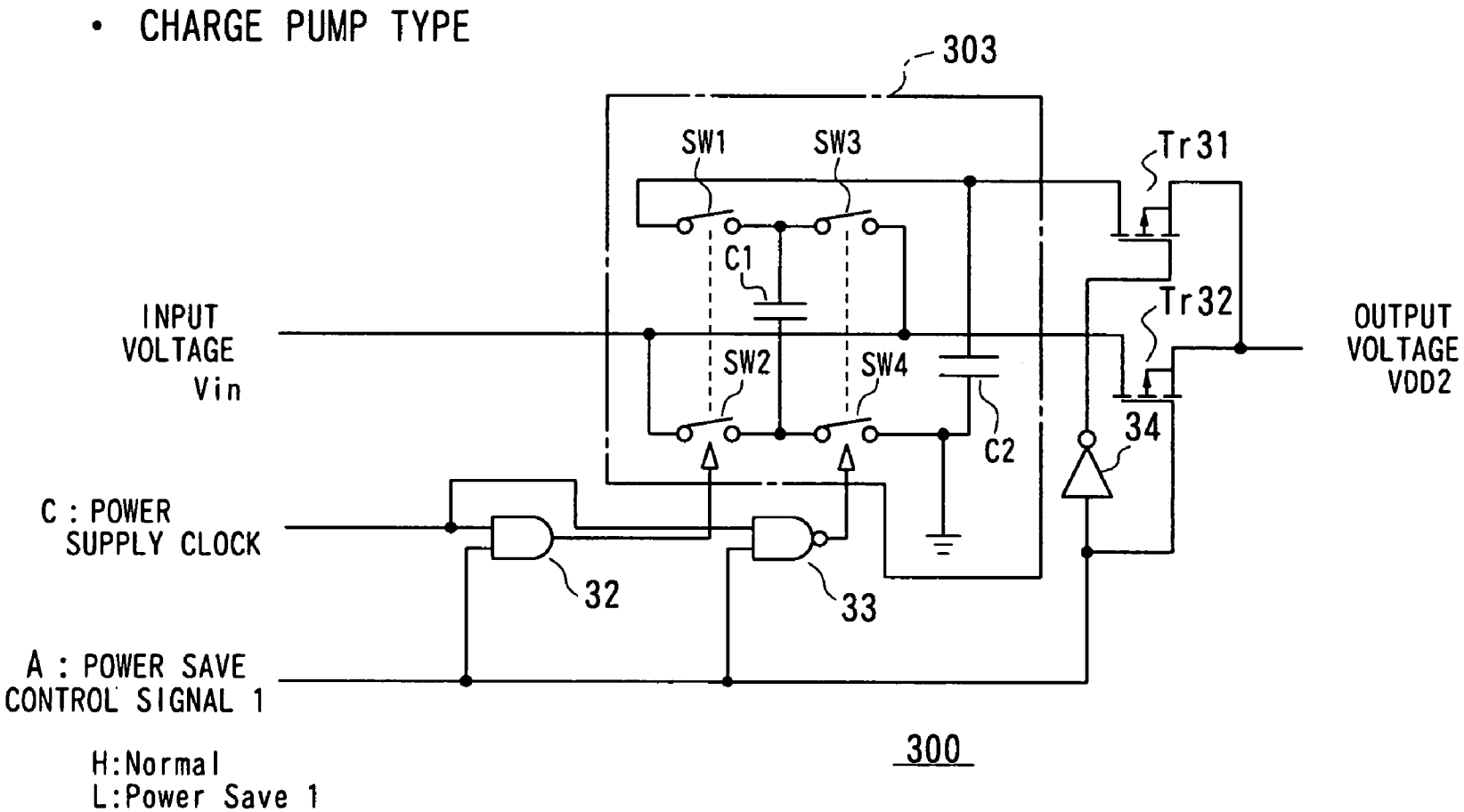
FIG. 8 is a diagram showing the structure of a power supply circuit of the display device according to a second embodiment of the present invention.
Figure 9:
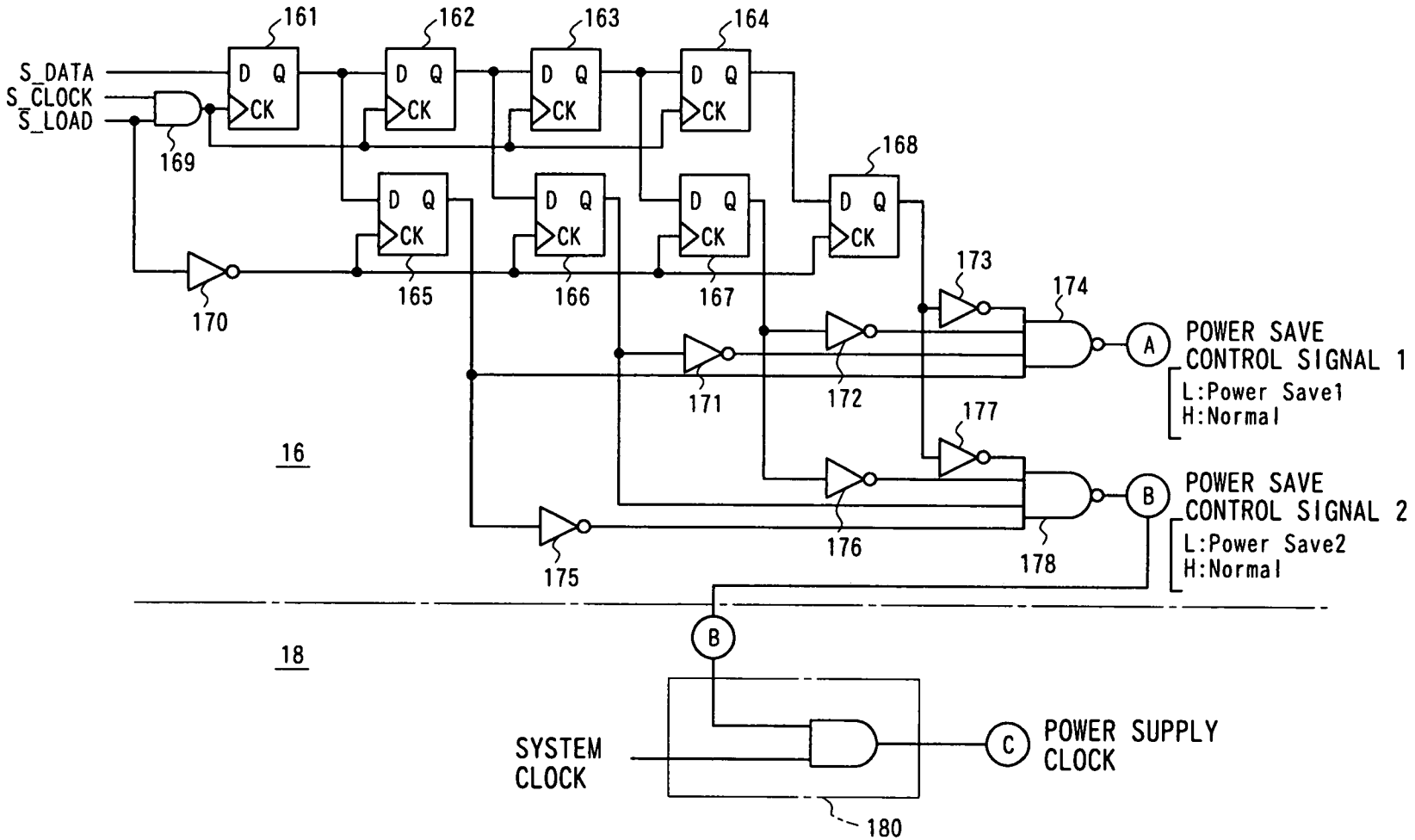
FIG. 9 is a diagram showing the structure of a power supply clock generating circuit within the CPU interface circuit and a timing controller of the display device according to the second embodiment of the present invention.
Figure 10:
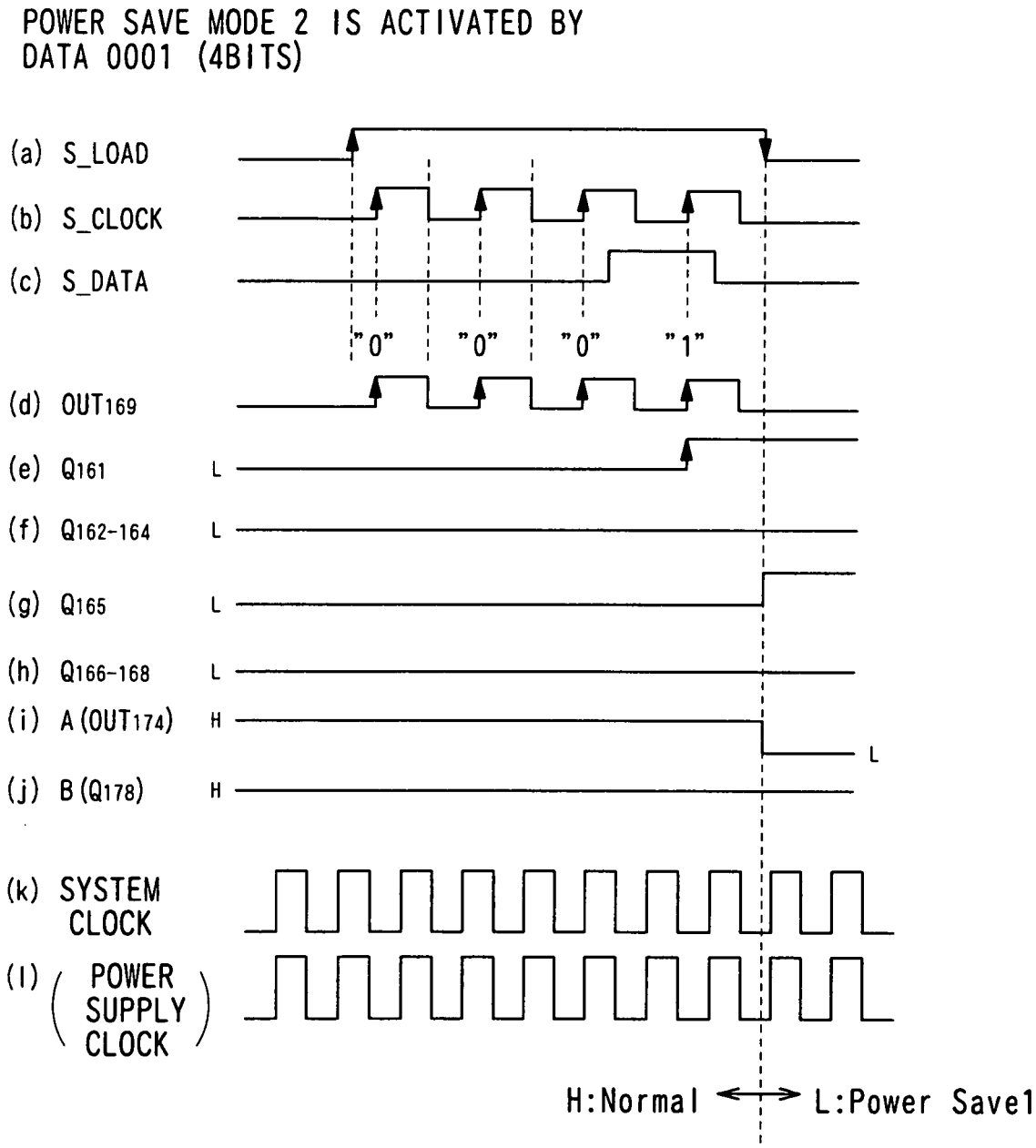
FIG. 10 is a timing chart showing the operation of the structure depicted in FIG. 9 during a power save mode 1.
Figure 11:
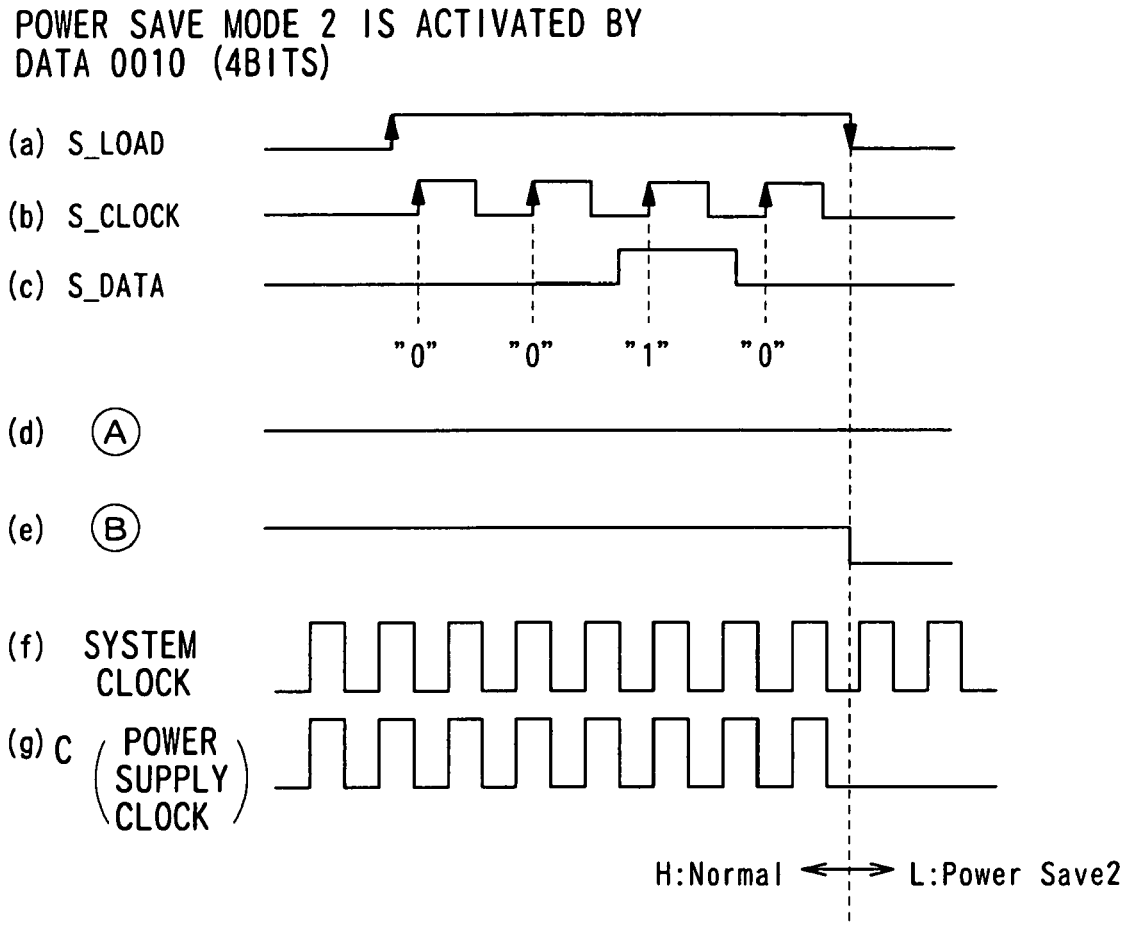
FIG. 11 is a timing chart showing the operation of the structure depicted in FIG. 9 during a power save mode 2.

The overall structure of the display device is shown in FIG. 3. In the second embodiment, a power save control signal 1 from the I/F circuit 16 (or the switch 400) and a power supply clock of the T/C circuit 18 shown by a two-dots-and-line in FIG. 3 are supplied to the power supply circuit 300. FIG. 8 shows the structure of the power supply circuit 300 according to the second embodiment. FIG. 9 shows the power supply clock generating section in the I/F circuit 16 and in the T/C 18 of the driving circuit 100. FIG. 10 shows the device operation of the second embodiment during power save mode 1, and FIG. 11 shows the device operation during power save mode 2.

In the power supply circuit 300, as shown in FIG. 8, the circuit for generating the supply voltage VDD2 which acts as the operation voltage of the analog circuits in the second embodiment is a charge pump type power supply circuit. As will be described later, the power supply circuit can be operated by receiving a power supply clock from the T/C circuit 18, and thus, the oscillation circuit 30*c* is not necessary. All other components are identical to those of the power supply circuit 300 shown in FIG. 5.

As shown in FIG. 9, the I/F circuit 16 comprises an AND gate 169, flip-flops (F/F) 161 through 168, inverters 170 through 173 and 175 through 177, and NAND gates 174 and 178. When the load signal (FIG. 10(*a*): S-LOAD) transmitted from the CPU becomes H level, the I/F circuit 16 captures control data (FIG. 10(*c*): S-DATA) at the rise of the clock (FIG. 10(*b*): S-CLOCK) supplied from the CPU, and generates corresponding control signals. The control data is comprised of 4 bits. In the following description, an example is shown in which the control data of "0001" shown in FIG. 10(*c*) represents a power save mode 1 wherein the supply voltage VDD2 is reduced from that during the normal operation, and the control data of "0010" shown in FIG. 11(*c*) represents a power save mode 2 wherein the power supply circuit is controlled to be turned off.

In FIG. 9, the F/Fs 161 through 164 in the I/F circuit 16 receive the AND output $OUT_{169}$ (FIG. 10(*d*)) between the clock (S-CLOCK) and the load signal (S-LOAD) on each of the clock terminals CK, sequentially capture the serial control data (S-DATA) supplied to the D terminals at the rise of the output $OUT_{169}$, and output the data from the Q terminal. The F/Fs 165 through 168 receive the inverted signal of the load signal (S-LOAD) output from the inverter 170 at the clock terminals CK, sequentially capture the Q output from corresponding F/Fs 161 through 164 supplied to the D terminals, and output from the Q terminal.

Power Save Mode 1 (control data 0001)

The operation when the instruction is power save mode 1 will now be described. Each of the F/Fs 161 through 164 captures the control data "0001" shown in FIG. 10(*c*) at the rises of the output $OUT_{169}$ shown in FIG. 10(*d*). As a result, the Q outputs ($Q_{162}$ through $Q_{164}$) of the F/Fs 162 through 164 maintain L level at all times during this period as shown in FIG. 10(*f*). The Q output ($Q_{161}$) of the F/F 161, on the other hand, changes from L level to H level at the fourth rise of the clock (S-CLOCK).

Because the F/F 165 captures the Q output ($Q_{161}$) of the F/F 161 at the fall of the load signal (S-LOAD) shown in FIG. 10(*a*), the Q output ($Q_{165}$) from the F/F 165 changes from L level to H level at the fall of the load signal (S-LOAD) as shown in FIG. 10 (*g*). As described above, because L level Q outputs of the F/Fs 162 through 164 are supplied to the D terminals of the F/Fs 166 through 168, each of the Q outputs ($Q_{166}$ through $Q_{168}$) remains at L level, even when the load signal (S-LOAD) falls, as shown in FIG. 10(*h*).

Q output ($Q_{165}$) from the F/F 165 and inverted outputs obtained by inverting the Q outputs ($Q_{166}$ through $Q_{168}$) from the F/Fs 166 through 168 at the inverters 171 through 173 are supplied to the NAND gate 174. Thus, as shown in FIG. 10(*i*), An L level signal is output from the NAND gate 174 when the level of the Q output ($Q_{165}$) and the levels of the inverted Q outputs ($Q_{166}$ through $Q_{168}$) are all at H level. In other words, a power save control signal 1(A) is output which changes to L level at the fall of the load signal only when the control data (S-DATA) supplied during the H level period of the load signal (S-LOAD) is "0001" (corresponding to power save mode 1).

Inverted output obtained by inverting the Q outputs ($Q_{165}$, $Q_{167}$, and $Q_{168}$) from the F/Fs 165, 167, and 168 at the inverters 175 through 177 and non-inverted Q output ($Q_{166}$) from the F/F 166 are supplied to the NAND gate 178. Thus, because there is no period where all inputs are at H level, the output $OUT_{178}$ from the NAND gate 178 becomes a power save control signal 2(B) which maintains H level at all times, as shown in FIG. 10(*j*).

Similar to the first embodiment, the power save control signal 1 output from the NAND gate 174 is supplied to the AND gate 32, the NAND gate 33, the transistor Tr31, and, via the inverter 34, to the transistor Tr32, of the power supply circuit 300 shown in FIG. 8.

The power save control signal 2 output from the NAND gate 178, on the other hand, is supplied to the power supply clock generating circuit 180 provided within the T/C 18 as shown in FIG. 9. The power supply clock generating circuit 180 generates a power supply clock based on the power save control signal 2 and the system clock commonly used with each IC or produced by individual IC. In the second embodiment, the power supply clock generating circuit 180 is constructed from an AND gate. The power save control signal 2 is input to one input of the AND gate and the system clock such as the one shown in FIG. 10(*k*) is input to the other input of the AND gate. When the control data (S-DATA) is "0001" as described above, the power save control signal 2 is at H level at all times, and, thus, the power supply clock generating circuit 180 uses the system clock (FIG. 10 (*k*)) as the power supply clock and outputs this clock to the power supply circuit 300.

When transitioning into the power save mode 1, the power supply circuit 300 operates as follows. During the normal operation, the power save control signal 1 output from the NAND gate 174 of the I/F circuit 16 is at H level. This power save control signal 1 controls the transistor Tr31 provided at the output end of the charge pump to be turned on via the inverter 34. The power save control signal 1 also controls the transistor Tr32 provided between the input and output ends to be turned off.

The power save control signal 2 also maintains H level during the normal operation, and the power supply clock corresponding to the system clock is output from the power supply clock generating circuit 180. The power supply clock is supplied to one input terminal of the AND gate 32 and one input terminal of the NAND gate 33. During normal operation, the power save control signal 1 supplied to the other input terminals of the AND gate 32 and NAND gate 33 of the power supply circuit 300 is at H level. Thus, during the normal operation, power supply clock is output with no inversion from the AND gate 32 to the switches SW1 and SW2, and with inversion from the NAND gate 33 to the switches SW3 and SW4, the switches SW1 and SW2, and SW3 and SW4 are alternately switched and controlled, and the output voltage VDD2 (for example 5V) obtained by boosting the input voltage Vin is output via the transistor Tr31.

When the load signal (S-LOAD) of FIG. 10(*a*) falls to L level, the apparatus transitions into the power save mode 1, and the power save control signal 1 falls to L level. Similar to the first embodiment, the transistor Tr31 is controlled to be turned off and the transistor Tr32 is controlled to be turned on. The input and output ends of the power supply circuit 300 are bypassed by the transistor Tr32 and the output from the boosting section 303 is shut out by the transistor Tr31.

As described above, in power save mode 1, the input voltage Vin is output from the power supply circuit 300 as the supply voltage VDD2 without boosting. The supply of the power supply clock is continued through power save mode 1. However, because the power save control signal 1 is at L level, the outputs of the AND gate 32 and NAND gate 33 are fixed.

Power Save Mode 2 (Control Data 0010)

An example of a power save mode 2 will now be described. In this case, because F/Fs 161 through 164 sequentially capture the control data "0010" of FIG. 11(*c*) at the rises of the output $OUT_{169}$ of FIG. 10(*d*), the Q outputs ($Q_{161}$, $Q_{163}$, and $Q_{164}$) of the F/Fs 161, 163, and 164 will remain in L level at all time, and only the Q output ($Q_{162}$) of the F/F 162 changes from L level to H level at the third rise of the clock (S-CLOCK)

Moreover, because the F/Fs 165 through 168 capture the Q outputs ($Q_{161}$ through $Q_{164}$) from the F/Fs 161 through 164 at the falls of the load signal (S-LOAD) of FIG, 11(*a*), only the Q output ($Q_{166}$) of the F/F 166 changes from L level to H level at the fall of the load signal (S-LOAD), and each of the other Q outputs ($Q_{165}$, $Q_{167}$, and $Q_{168}$) from the F/Fs 165, 167, and 168 remains at L level.

Therefore, the power save control signal 1(A) output from the NAND gate 174 will be maintained at H level at all times, as shown in FIG. 11(*d*), because the input levels never coincide. The power save control signal 2 at the NAND gate 178, on the other hand, changes to L level when the load signal (S-LOAD) falls and the output of the F/F 166 changes to H level, at which point all the input levels to the NAND gate 178 become H level, as shown in FIG. 11(*e*). When the power save control signal 2 becomes L level, the output of the system clock (FIG. 11(*f*)) from the power supply clock generating circuit 180 of FIG. 9 is prohibited, and the output is fixed at L level as shown in FIG. 11(*g*). Thus, supply of the power supply clock to the power supply circuit 300 is suspended.

The power supply circuit 300 generates an output voltage VDD2 obtained by boosting the input voltage Vin during the normal operation period until the load signal (S-LOAD) falls (FIG. 11(*a*)). When the load signal (S-LOAD) falls, the power supply circuit 300 transitions into the power save mode 2. When this happens, the power supply clock from the power supply clock generating circuit 180 is fixed at L level, causing the switches SW1 and SW2 to open and continue to be opened, and SW3 and SW4 to close and continue to be closed. Because the power save mode 1 is maintained at H level, the transistor Tr32 is controlled to be turned off and the transistor Tr31 is controlled to be turned on, and, thus, the output of voltage VDD2 from the power supply circuit 300 is suspended.

During the power save mode 2, at least the VDD2 of the power supply circuit 300 is controlled to be turned off, and the analog circuits in the driving circuit 100 cannot operate. Although not shown, VDD1 and VDD3 can also be controlled to be turned off during power save mode 2, and the power consumption at the driving circuit or the like can be completely shut off, resulting in significant reduction in the power consumption of the display device. Because the device does not demand display during the power save mode 2, there will be no consequence on the display, even when the generation of the power supply clock is suspended and the power supply circuit 300 is controlled to be turned off.

Figure 5:
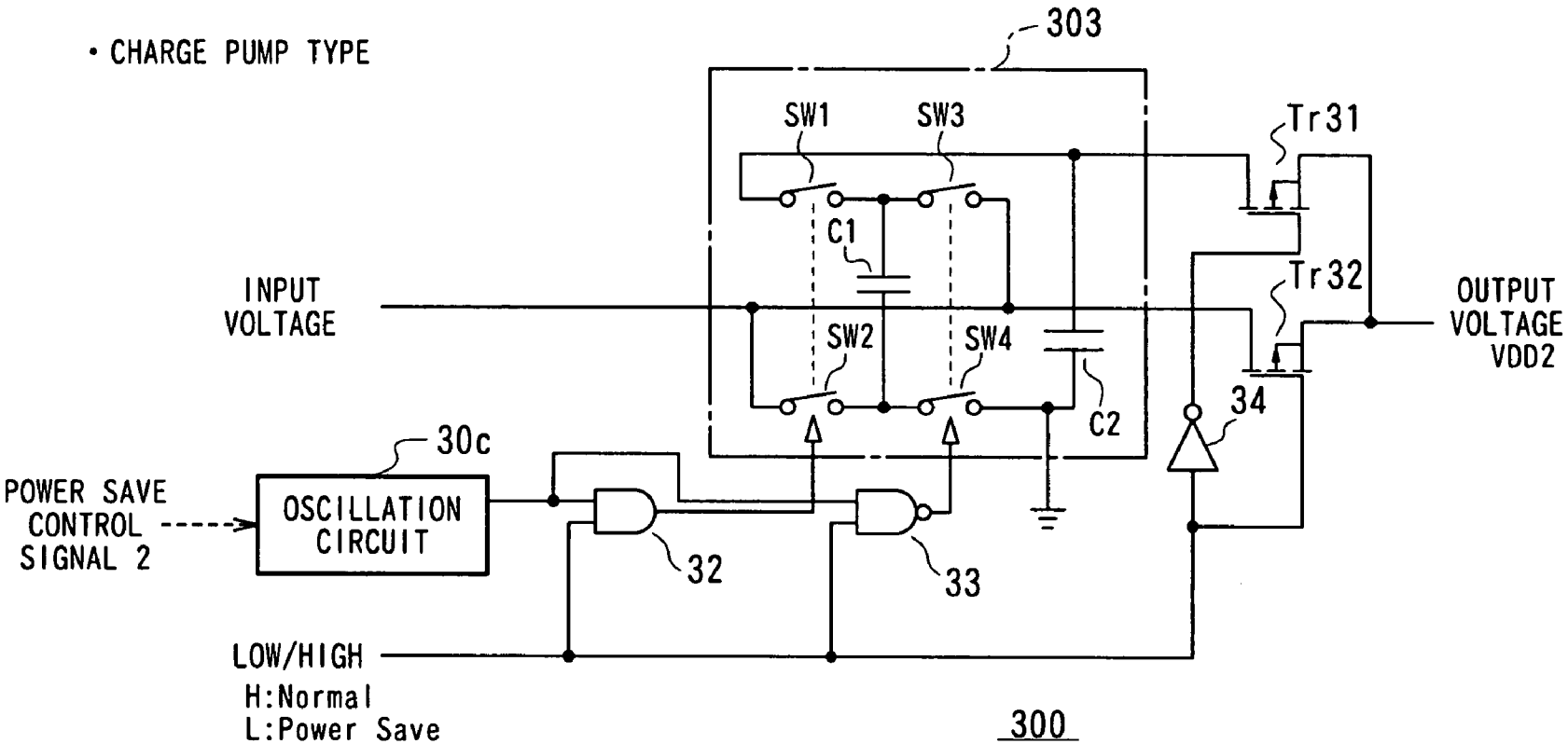
FIG. 5 is a diagram showing the structure of a charge pump type power supply circuit of the display device according to the first embodiment of the present invention.

The structure of the power supply circuit 300 is not limited to the structure shown in FIG. 8, and can, for example, also be a power supply circuit 300 as shown in FIG. 5 for the first embodiment. The power save mode 1 can be realized in the power supply circuit 300 of FIG. 5 by switching and controlling the transistors Tr31 and Tr32 based on the power save control signal 1(A) output from the NAND gate 174 of FIG. 9, similar to the first embodiment. The power save mode 2 can be realized by supplying the power save control signal 2(B) output from the NAND gate 178 of FIG. 9 to the oscillation circuit 30*c* to suspend the oscillation operation of the oscillation circuit 30*c* in response to the control signal 2, and, at the same time, switch the transistors Tr31 and Tr32 using the power save control signal 1 so that Tr31 is controlled to be turned on.

As described, according to the second embodiment, it is possible to save power by reducing the supply voltage than during the normal operation so that display is possible while power consumption is reduced, or by controlling the power supply to be turned off so that the power consumption at the circuits using the power supply as the operation power supply is shut off. Therefore, it is advantageous in a high performance instrument which can be used easily and which is capable of limiting the maximum power consumption when desired.

The circuit 180 for generating the power supply clock can be constructed using an AND gate for taking the logical product between the power save control signal 2 and the system clock. The AND gate can be easily built into the driving circuit IC (100), requiring only a small area. When a power supply clock is employed, no oscillation circuit is necessary at the power supply circuit 300, and, thus, it is possible to configure the power supply circuit 300 such that all components other than the capacitors C1 and C2 are provided, for example, on the same IC as the driving circuit 100. Therefore, a small area driving section for the display device including the power supply circuit and the driving circuit can be realized.

The power supply clock generating circuit 180 may, as described above, output the system clock itself as the power supply clock during the normal operation period, or output a clock which has identical frequency as the system clock but having different amplitude and/or pulse width based on the ratio of the capacitors C1 and C2 or the like in the power supply circuit 300. Also, it is possible to use a structure wherein a clock having an optimal frequency for the power supply circuit 300 is generated considering the capacitance values of the capacitors C1 and C2, based on the system clock during the normal operation.

In the present invention, the display device is not limited to a liquid crystal display device used as an example in the descriptions of the first and second embodiments above, and the same advantage can be obtained with other flat panel display devices such as, for example, an organic EL display device. In a display device such as a liquid crystal display device, some type of system clock is used at the driving circuit for display. By employing the system clock, as in the second embodiment, no oscillation circuit is necessary at the power supply circuit, and a power supply clock can be produced with just a simple structure.

Application of the power supply circuit of the present invention as described above is not limited to a power supply for the display device. The present invention can also be used as a power supply circuit for other devices having a power save mode capability.

The recovery from the power save mode to the normal operation in the first and second embodiments can be realized by, for example, the I/F circuit analyzing control data when the control data transmitted from the CPU represents a predetermined normal operation instruction when the load signal (S-LOAD) from the CPU next becomes H level, and returning the power save control signal A (in the second embodiment, both power save control signals 1 and 2) to H level.

As described above, the driving apparatus according to the present invention for a display device reduces the supply voltage to the digital-to-analog converter circuit and to the analog signal processing circuit in the driving circuit when power save is instructed, and is, therefore, capable of reducing the power consumption at these circuits which process an analog signal. Moreover, such a circuit for processing an analog signal in the present invention can be operated even when the supply voltage is reduced, and can therefore generate a signal for allowing the display section to display even during the power save mode.

The power supply circuit for supplying supply voltage to such a driving circuit can be of any form which can selectively output a non-boosted supply voltage when a power save instruction is given, and, therefore, can be realized by a simple and easily controllable structures such as resistive elements for detecting the supply voltage and a selector switch for the resistive elements, or a boosted power supply output switch and non-boosted power supply output switch, or the like.

The driving apparatus according to the present invention for a display device determines the mode which the apparatus is in, boosted power supply generating mode, non-boosted power supply generating mode, or power supply suspension mode, based on the power save control instruction, and is capable of controlling the power supply to the digital-to-analog converter circuit and to the analog signal processing circuit based on the determination. Therefore, many operation modes can be implemented with a simple structure and, at the same time, the power consumption can be reduced. In particular, it is possible, if necessary, to reduce the power consumption while continuing to display. Also, when the reduction in power consumption is a higher priority, the power supply can be controlled to be turned off with a simple structure.

What is claimed is:

1. A driving apparatus for a display device, comprising:

a driving circuit for generating a signal to allow a display section to display, said driving circuit having a digital signal processing circuit for processing a digital signal, a digital-to-analog converter circuit for converting a digital display signal to an analog display signal, and an analog signal processing circuit for processing an analog display signal; and a power supply circuit for generating a supply voltage for said driving circuit; wherein said power supply circuit reduces the supply voltage supplied to said digital-to-analog converter circuit and to said analog signal processing circuit, from the supply voltage during the normal operation to a voltage which still allows said digital-to-analog converter circuit and said analog signal processing circuit to operate, when a predetermined power save is instructed;

wherein a period in which said predetermined power save is instructed and said supply voltage is reduced includes a period in which display data is written to said display section and a display is realized; and wherein during a period in which said predetermined power save is instructed and said supply voltage is reduced, said digital-to-analog converter circuit outputs an analog display signal corresponding to a digital display signal.

2. A driving apparatus for a display device according to claim 1, wherein said power supply circuit comprises:

a boosting section for boosting the supply voltage;

a feedback section for detecting the supply voltage at the output end of the power supply as a resistor divided voltage, comparing the detected voltage with a reference voltage, and controlling said boosting section so that said supply voltage is constant;

a plurality of resistive elements each with a different resistance value and connected to said output end of the power supply for detecting said supply voltage; and a selector switch for selecting a resistive element to be connected to said feedback section from among said plurality of resistive elements; wherein a divided voltage value of said supply voltage which is input to said feedback section is adjusted in response to the resistance value of the resistive element selected by said selector switch, and the output supply voltage to said digital-to-analog converter circuit and to said analog signal processing circuit is changed.

3. A driving apparatus for a display device according to claim 2, wherein a resistive element with a lower resistance value is selected by said selector switch when reduction in the output supply voltage is desired so that the divided voltage value input to said feedback section is increased.

4. A driving apparatus for a display device according to claim 1, wherein said power supply circuit comprises:

a boosting section for boosting the input voltage;

a boosted power supply output switch for controlling passage between said boosting section and an output end of the power supply; and a non-boosted power supply output switch for bypassing the input and said output ends of power supply; wherein said boosted power supply output switch and said non-boosted power supply output switch are switched and controlled such that one of the boosted or non-boosted supply voltages is output to said digital-to-analog converter circuit and to said analog signal processing circuit.

5. A driving apparatus for a display device according to claim 1, wherein said power supply circuit comprises:

a boosting section, including a plurality of capacitors and a plurality of switches for capacitors, for boosting an input voltage by switching and controlling said plurality of switches for capacitors;

a boosted power supply output switch for controlling the passage between said boosting section and output end of the power supply; and a non-boosted power supply output switch for bypassing an input end of the power supply and said output end of the power supply; wherein a power supply clock produced by said driving circuit using the system clock is used for switching and controlling said plurality of switches for capacitors; and one of the boosted or non-boosted supply voltages is output to said digital-to-analog converter circuit and to said analog signal processing circuit, or the output of said supply voltage to these circuits is suspended in response to said power supply clock and the switching control of said boosted power supply output switch and said non-boosted power supply output switch.

6. A driving apparatus for a display device according to claim 5, wherein said driving circuit determines a current mode from a boosted power supply generating mode, a non-boosted power supply generating mode, or a power supply suspension mode based on a predetermined power save control instruction, and based on the determination controls supply and suspension of supply of said power supply clock or supply and suspension of supply of the clock from an oscillation circuit, and opening/closing of said boosted power supply output switch and said non-boosted power supply output switches.

7. A driving apparatus for a display device according to claim 1, wherein said power supply circuit comprises:

a boosting section, including a plurality of capacitors and a plurality of switches for capacitors, for boosting the input voltage by switching and controlling said switches for capacitors;

a boosted power supply output switch for controlling the passage between said boosting section and output end of the power supply; and a non-boosted power supply output switch for bypassing an input end of the power supply and said output end of the power supply; wherein a clock from a oscillation circuit is used for the switch control of said plurality of switches for capacitors; and one of the boosted or non-boosted supply voltages is output to said digital-to-analog converter circuit and to said analog signal processing circuit, or the output of said supply voltage to these circuits is suspended in response to the clock from said oscillator circuit and the switching control of said boosted power supply output switch and said non-boosted power supply output switch.

8. A driving apparatus for a display device according to claim 1, wherein said digital-to-analog converter circuit includes a plurality of voltage dividing resistive elements connected in series to the power supply from said power supply circuit, divides said supply voltage into a plurality of stages by said voltage dividing resistive elements, selects a divided voltage corresponding to the digital display data, and outputs an analog display signal.

9. A driving apparatus for a display device according to claim 8, wherein said power supply circuit comprises:

a boosting section for boosting the supply voltage;

a feedback section for detecting the supply voltage at the output end of the power supply as a resistor divided voltage, comparing the detected voltage with a reference voltage, and controlling said boosting section so that said supply voltage is maintained;

a plurality of resistive elements each with a different resistance value and connected to said output end of the power supply for detecting said supply voltage; and a selector switch for selecting a resistive element to be connected to said feedback section from among said plurality of resistive elements; wherein a divided voltage value of said supply voltage input to said feedback section is adjusted in response to the resistance value of the resistive element selected by said selector switch, and the output supply voltage to said digital-to-analog converter circuit and to said analog signal processing circuit is changed.

10. A driving apparatus for a display device according to claim 9, wherein a resistive element with lower resistance value is selected by said selector switch when reduction in the output supply voltage is desired so that the divided voltage value input to said feedback section is increased.

11. A driving apparatus for display device according to claim 8, wherein said power supply circuit comprises:

a boosting section for boosting the input voltage;

a boosted power supply output switch for controlling passage between said boosting section and an output end of power supply; and a non-boosted power supply output switch for bypassing an input end of the power supply and said output end of the power supply; wherein said boosted power supply output switch and said non-boosted power supply output switch are switched and controlled so that one of the boosted or non-boosted supply voltage is output to said digital-to-analog converter circuit and to said analog signal processing circuit.

12. A driving apparatus for a display device according to claim 8, wherein said power supply circuit comprises:

a boosting section, including a plurality of capacitors and a plurality of switches for capacitors, for boosting an input voltage by switching and controlling said plurality of switches for capacitors;

a boosted power supply output switch for controlling the passage between said boosting section and output end of the power supply; and a non-boosted power supply output switch for bypassing an input end of the power supply and said output end of the power supply; wherein a power supply clock produced by said driving circuit using the system clock is used for switching and controlling said plurality of switches for capacitors; and one of the boosted or non-boosted supply voltages is output to said digital-to-analog converter circuit and to said analog signal processing circuit, or the output of said supply voltage to these circuits is suspended in response to said power supply clock and the switching control of said boosted power supply output switch and said non-boosted power supply output switch.

13. A driving apparatus for a display device according to claim 12, wherein said driving circuit determines the current mode from a boosted power supply generating mode, a non-boosted power supply generating mode, or a power supply suspension mode, based on a predetermined power save control instruction, and based on the determination, controls supply and suspension of supply of said power supply clock, or supply and suspension of supply of the clock from an oscillation circuit, and opening/closing of said output switches of said power supply circuit.

14. A driving apparatus for a display device according to claim 8, wherein said power supply circuit comprises:

a boosting section, including a plurality of capacitors and a plurality of switches for capacitors, for boosting the input voltage by switching and controlling said switches for capacitors;

a boosted power supply output switch for controlling the passage between said boosting section and output end of the power supply; and a non-boosted power supply output switch for bypassing an input end of the power supply and said output end of the power supply; wherein a clock from an oscillation circuit is used for the switch control of said plurality of switches for capacitors; and one of the boosted or non-boosted supply voltages is output to said digital-to-analog converter circuit and to said analog signal processing circuit, or the output of said supply voltage to these circuits is suspended in response to the clock from said oscillation circuit and the switching control of said boosted power supply output switch and said non-boosted power supply output switch.

15. A driving circuit for a display device for generating a signal to allow a display section to display, said driving circuit comprising:

a digital signal processing circuit for processing a digital signal;

a digital-to-analog converter circuit for converting a digital display signal to an analog display signal; and an analog signal processing circuit for processing an analog display signal; wherein when a predetermined power save is instructed, said digital-to-analog converter circuit operates to perform a digital-to-analog conversion process and said analog signal processing circuit operates to process an analog display signal with a supply voltage which is less than the supply voltage during normal operation and which still allows said digital-to-analog converter circuit and said analog signal processing circuit to operate;

wherein a period in which said predetermined power save is instructed and said supply voltage is reduced includes a period in which display data is written to said display section and a display is realized; and wherein during a period in which said predetermined power save is instructed and said supply voltage is reduced, said digital-to-analog converter circuit outputs an analog display signal corresponding to a digital display signal.

16. A driving apparatus for a display device, comprising:

a driving circuit for generating a signal to allow a display section to display, said driving circuit having a digital signal processing circuit for processing a digital signal, a digital-to-analog converter circuit for converting a digital display signal to an analog display signal, and an analog signal processing circuit for processing an analog display signal; and a power supply circuit for generating a supply voltage for said driving circuit; wherein when a predetermined power save is instructed, said power supply circuit reduces the supply voltage supplied to said digital-to-analog converter circuit and to said analog signal processing circuit, from the supply voltage during normal operation to a voltage which allows said digital-to-analog converter circuit and said analog signal processing circuit to operate and said display section to display;

wherein a period in which said predetermined power save is instructed and said supply voltage is reduced includes a period in which display data is written to said display section and a display is realized; and wherein during a period in which said predetermined power save is instructed and said supply voltage is reduced, said digital-to-analog converter circuit outputs an analog display signal corresponding to a digital display signal.

17. A driving apparatus for a display device according to claim 16, wherein as an instruction of said predetermined power save, at least two instructions exist, the first being an output instruction of a power save supply voltage which is lower than an output supply voltage from said power supply circuit during normal operation and the second being a stop instruction of an output voltage from said power supply circuit, and when the output of said power save supply voltage is instructed, said power supply circuit sets, as said power save supply voltage, the supply voltage to be supplied to said digital-to-analog converter circuit and to said analog signal processing circuit to a voltage which is lower than the supply voltage during normal operation and which allows said digital-to-analog converter circuit and said analog signal processing circuit to operate and said display section to display.

18. A driving circuit for a display device for generating a signal to allow a display section to display, said driving circuit comprising:

a digital signal processing circuit for processing a digital signal;

a digital-to-analog converter circuit for converting a digital display signal to an analog display signal; and an analog signal processing circuit for processing an analog display signal; wherein when a predetermined power save is instructed, said digital-to-analog converter circuit and said analog signal processing circuit operate with a supply voltage less than the supply voltage during normal operation to a voltage which allows said display section to display;

wherein a period in which said predetermined power save is instructed and said supply voltage is reduced includes a period in which said display data is written to said display section and a display is realized; and wherein during a period in which said predetermined power save is instructed and said supply voltage is reduced, said digital-to-analog converter circuit outputs an analog display signal corresponding to a digital display signal.

19. A driving circuit for a display device according to claim 18, wherein as an instruction of said predetermined power save, at least two instructions exist, the first being an output instruction of a power save supply voltage which is lower than an output supply voltage from said power supply circuit during normal operation and the second being a stop instruction of an output voltage from said power supply circuit, and when the output of said power save supply voltage is instructed, said digital-to-analog converter circuit and said analog signal processing circuit operates with said power save supply voltage which is less than the supply voltage during normal operation and which allows said display section to display.

20. A driving apparatus for a display device according to claim 1, wherein the power supply circuit reduces the supply voltage supplied from the supply voltage during the normal operation to a reduced voltage which is less than the supply voltage during the normal operation but greater than zero and which still allows said digital-to-analog converter circuit and said analog signal processing circuit to operate, when a predetermined power save is instructed.

21. A driving circuit for a display device according to claim 15, wherein when a predetermined power save is instructed, said analog signal processing circuit operates to process an analog display signal with a supply voltage which is less than the supply voltage during normal operation but greater than zero and which still allows said digital-to-analog converter circuit and said analog signal processing circuit to operate.

22. A driving apparatus for a display device according to claim 16, wherein when a predetermined power save is instructed, said power supply circuit reduces the supply voltage supplied to said digital-to-analog converter circuit and to said analog signal processing circuit, from the supply voltage during normal operation to a reduced voltage which is less than the supply voltage during normal operation but greater than zero and which still allows said digital-to-analog converter circuit and said analog signal processing circuit to operate.

23. A driving circuit for a display device according to claim 18, wherein when a predetermined power save is instructed, said digital-to-analog converter circuit and said analog signal processing circuit operate with a supply voltage which is less than the supply voltage during normal operation but greater than zero and which still allows said display section to display.

24. A driving apparatus for a display device according to claim 1, wherein a display panel supplies an analog display signal applied from the analog processing circuit of the driving circuit to a corresponding pixel to perform display.

25. A driving apparatus for a display device according to claim 24, wherein said power supply circuit comprises:

a boosting section for boosting the supply voltage;

a feedback section for detecting the supply voltage at the output end of the power supply as a resistor divided voltage, comparing the detected voltage with a reference voltage, and controlling said boosting section so that said supply voltage is constant;

a plurality of resistive elements each with a different resistance value and connected to said output end of the power supply for detecting said supply voltage; and a selector switch for selecting a resistive element to be connected to said feedback section from among said plurality of resistive elements; wherein a divided voltage value of said supply voltage input to said feedback section is adjusted in response to the resistance value of the resistive elements selected by said selector switch, and the output supply voltage to said digital-to-analog converter circuit and to said analog signal processing circuit is changed.

26. A display device comprising a driving apparatus and a display section, the driving apparatus comprising:

a driving circuit for generating a signal to allow said display section to display, said driving circuit having a digital signal processing circuit for processing a digital signal, a digital-to-analog converter circuit for converting a digital display signal to an analog display signal, and an analog signal processing circuit for processing an analog display signal; and a power supply circuit for generating a supply voltage for said driving circuit; wherein said power supply circuit reduces the supply voltage supplied to said digital-to-analog converter circuit and to said analog signal processing circuit, from the supply voltage during the normal operation to a voltage which still allows said digital-to-analog converter circuit and said analog signal processing circuit to operate, when a predetermined power save is instructed;

wherein a period in which said predetermined power save is instructed and said supply voltage is reduced includes a period in which display data is written to said display section and a display is realized; and wherein during a period in which said predetermined power save is instructed and said supply voltage is reduced, said digital-to-analog converter circuit outputs an analog display corresponding to a digital display signal; and wherein the display section provides a display in response to a signal provided by the driving apparatus, and the display device is switchable between a normal display mode and a power save mode.

27. A display device according to claim 26, wherein the power save mode includes a non-boosted power supply generating mode and a power supply suspension mode, and when the non-boosted power supply generating mode is instructed, the driving circuit determines the instruction and reduces the supply voltage supplied to the digital-to-analog converter circuit and to the analog signal processing circuit to a voltage which is less than the voltage during the normal operation.

* * * * *